US008777642B2

(12) United States Patent
Pujol et al.

(10) Patent No.: US 8,777,642 B2
(45) Date of Patent: Jul. 15, 2014

(54) ELECTRICAL CONNECTOR

(75) Inventors: Antoni Pujol, Valls (ES); Yunlong Cao, Shanghai (CN)

(73) Assignee: Lear Corporation, Southfield, MI (US)

( * ) Notice: Subject to any disclaimer, the term of this patent is extended or adjusted under 35 U.S.C. 154(b) by 131 days.

(21) Appl. No.: 13/529,548

(22) Filed: Jun. 21, 2012

(65) Prior Publication Data

US 2013/0342007 A1 Dec. 26, 2013

(51) Int. Cl.
*H01R 4/66* (2006.01)

(52) U.S. Cl.
USPC ..... 439/97

(58) Field of Classification Search
USPC ..... 439/97, 801, 883, 868; 361/701
See application file for complete search history.

(56) References Cited

U.S. PATENT DOCUMENTS

| | | | | |
|---|---|---|---|---|
| 3,154,366 | A * | 10/1964 | James et al. | 439/712 |
| 4,072,377 | A * | 2/1978 | Van de Loo et al. | 439/76.1 |
| 4,087,666 | A * | 5/1978 | DeHaitre | 200/507 |
| 4,577,402 | A * | 3/1986 | Swanstrom | 29/840 |
| 4,627,677 | A * | 12/1986 | Ono et al. | 439/75 |
| 4,745,530 | A * | 5/1988 | Farrell et al. | 362/549 |
| 4,812,130 | A | 3/1989 | Altenschulte et al. | |
| 5,336,113 | A * | 8/1994 | Chanteau | 439/581 |
| 5,462,440 | A | 10/1995 | Rothenberger | |
| 6,144,557 | A * | 11/2000 | Chen et al. | 361/704 |
| 6,230,403 | B1 | 5/2001 | Skoolicas et al. | |
| 6,283,765 | B1 * | 9/2001 | Lumbis et al. | 439/35 |
| 6,343,963 | B1 * | 2/2002 | Bronk | 439/805 |
| 6,473,304 | B1 | 10/2002 | Stevens | |
| 7,088,591 | B2 | 8/2006 | Kishimoto et al. | |
| 7,462,043 | B2 | 12/2008 | Deisenhofer | |
| 7,553,200 | B2 * | 6/2009 | Plummer | 439/766 |
| 7,828,613 | B2 * | 11/2010 | Chen | 439/883 |
| 8,047,868 | B1 * | 11/2011 | Korczynski | 439/522 |

OTHER PUBLICATIONS

Amphenol, "Amphe-Power® Connectors with RADSOK® Technology", copyright 2012, published on or before Jan. 20, 2012, 29 pages.
http://www.amphenol-industrial.com/index.php/radsert, "Radsert—Amphenol's Board Level Product High Amperage,Board Level, Power, Industrial RADSOKs®", copyright 2012, published on or before Jan. 20, 2012, 1 page.

* cited by examiner

*Primary Examiner* — Neil Abrams
*Assistant Examiner* — Phuongchi T Nguyen
(74) *Attorney, Agent, or Firm* — Brooks Kushman P.C.

(57) ABSTRACT

An electrical connector is provided with a conductive body sized to be inserted into a printed circuit board (PCB) aperture. The body has an external profile that is not round to inhibit rotation relative to a corresponding aperture in the PCB. The body has a round aperture formed therein for receipt of an elongate conductive fastener. A circuit board assembly is provided with a PCB aperture that is not round for receipt of the connector. A circuit housing assembly is provided with a housing with an aperture. A conductive stud extends through the PCB aperture and the housing aperture. A conductive nut is mounted on the stud adjacent to the connector. A vehicle power interface is provided with a power supply with a conductive connector received upon the stud on an external side of the housing. A conductive nut is mounted on the stud adjacent to the power supply connector.

17 Claims, 4 Drawing Sheets

ELECTRICAL CONNECTOR

TECHNICAL FIELD

Various embodiments relate to electrical connectors.

BACKGROUND

The prior art has provided electrical connectors for printed circuit boards (PCBs). The prior art connectors often employ internal busbars to separate an external connection to an internal connection on a PCB. The busbar is fastened to the PCB by a screw.

SUMMARY

According to at least one embodiment, an electrical connector is provided with a conductive body that is sized to be inserted into an aperture of a PCB for electrical connection with a circuit on the PCB. The body has an external profile that is not round to inhibit rotation of the body relative to a corresponding aperture in the PCB. The body has a round aperture formed therein for receipt of an elongate conductive fastener for mechanical and electrical connection with the fastener.

According to at least another embodiment, a circuit board assembly is provided with a PCB with an aperture that is not round. An electrical connector is received within the aperture. The electrical connector is provided with a conductive body that is sized to be inserted into the aperture of the PCB for electrical connection with a circuit on the PCB. The body has an external profile that is not round to inhibit rotation of the body relative to the corresponding aperture in the PCB. The body has a round aperture formed therein for receipt of an elongate conductive fastener for mechanical and electrical connection with the fastener.

According to at least another embodiment, a circuit housing assembly is provided with a housing with an aperture. A circuit board assembly is provided with a PCB with an aperture that is not round. An electrical connector is received within the aperture. The electrical connector is provided with a conductive body that is sized to be inserted into the aperture of the PCB for electrical connection with a circuit on the PCB. The body has an external profile that is not round to inhibit rotation of the body relative to the corresponding aperture in the PCB. The body has a round aperture formed therein for receipt of an elongate conductive fastener for mechanical and electrical connection with the fastener. A conductive stud extends through the PCB aperture and the housing aperture. A conductive nut is mounted on the stud adjacent to the connector.

According to at least one embodiment, a vehicle power interface is provided with a circuit housing assembly with a housing with an aperture. A circuit board assembly is provided with a PCB with an aperture that is not round. An electrical connector is received within the aperture. The electrical connector is provided with a conductive body that is sized to be inserted into the aperture of the PCB for mechanical and electrical connection with a circuit on the PCB. The body has an external profile that is not round to inhibit rotation of the body relative to the corresponding aperture in the PCB. The body has a round aperture formed therein for receipt of an elongate conductive fastener for electrical connection with the fastener. A conductive stud extends through the PCB aperture and the housing aperture. A conductive nut is mounted on the stud adjacent to the connector. A power supply has a conductive connector received upon the stud on an external side of the housing. A conductive nut is mounted on the stud adjacent to the power supply connector.

According to at least one embodiment, an electrical connector includes a generally cylindrical conductive sleeve that is sized to be inserted into an aperture of a PCB for mechanical and electrical connection with a circuit on the PCB. The body has a round aperture formed therein for receipt of an elongate conductive fastener for electrical connection with the fastener. At least one projection extends outward from the sleeve providing an external profile to inhibit rotation of the body relative to a corresponding aperture in the PCB.

According to at least another embodiment, a circuit board assembly is provided with a PCB with an aperture that is generally cylindrical with an extension therefrom. An electrical connector includes a generally cylindrical conductive sleeve that is sized to be inserted into an aperture of the PCB for mechanical and electrical connection with a circuit on the PCB. The body has a round aperture formed therein for receipt of an elongate conductive fastener for electrical connection with the fastener. At least one projection extends outward from the sleeve providing an external profile to inhibit rotation of the body relative to a corresponding aperture in the PCB.

According to at least another embodiment, an electrical connector is provided with a conductive body that is sized to be inserted into an aperture of a PCB for electrical connection with a circuit on the PCB. The body has an aperture formed therein for receipt of an elongate conductive fastener for mechanical and electrical connection with the fastener. A flange extends from the body with a bonding surface. At least one projection extends from the bonding surface to contact the PCB and to space the bonding surface away from the PCB for receipt of an adherent on the bonding surface.

According to at least another embodiment, a circuit board assembly is provided with a PCB with an aperture. An electrical connector is provided with a conductive body that is sized to be inserted into an aperture of a PCB for electrical connection with a circuit on the PCB. The body has an aperture formed therein for receipt of an elongate conductive fastener for mechanical and electrical connection with the fastener. A flange extends from the body with a bonding surface. At least one projection extends from the bonding surface to contact the PCB and to space the bonding surface away from the PCB for receipt of an adherent on the bonding surface.

According to at least one embodiment, a circuit housing assembly is provided with a housing with an aperture. A circuit board assembly is provided with a PCB with an aperture. An electrical connector is provided with a conductive body that is sized to be inserted into an aperture of a PCB for mechanical and electrical connection with a circuit on the PCB. The body has an aperture formed therein for receipt of an elongate conductive fastener for electrical connection with the fastener. A flange extends from the body with a bonding surface. At least one projection extends from the bonding surface to contact the PCB and to space the bonding surface away from the PCB for receipt of an adherent on the bonding surface. The PCB aperture is aligned with the housing aperture. A conductive stud extends through the PCB aperture and the housing aperture. A conductive nut is mounted on the stud adjacent to the connector.

According to at least one embodiment, a vehicle power interface is provided with a circuit housing assembly with a housing with an aperture. A circuit board assembly is provided with a PCB with an aperture. An electrical connector is provided with a conductive body that is sized to be inserted into an aperture of a PCB for electrical connection with a circuit on the PCB. The body has an aperture formed therein for receipt of an elongate conductive fastener for mechanical and electrical connection with the fastener. A flange extends from the body with a bonding surface. At least one projection extends from the bonding surface to contact the PCB and to space the bonding surface away from the PCB for receipt of an adherent on the bonding surface. The PCB aperture is aligned with the housing aperture. A conductive stud extends through the PCB aperture and the housing aperture. A conductive nut is mounted on the stud adjacent to the connector. A power supply has a conductive connector received upon the stud on an external side of the housing. A conductive nut is mounted on the stud adjacent to the power supply connector.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
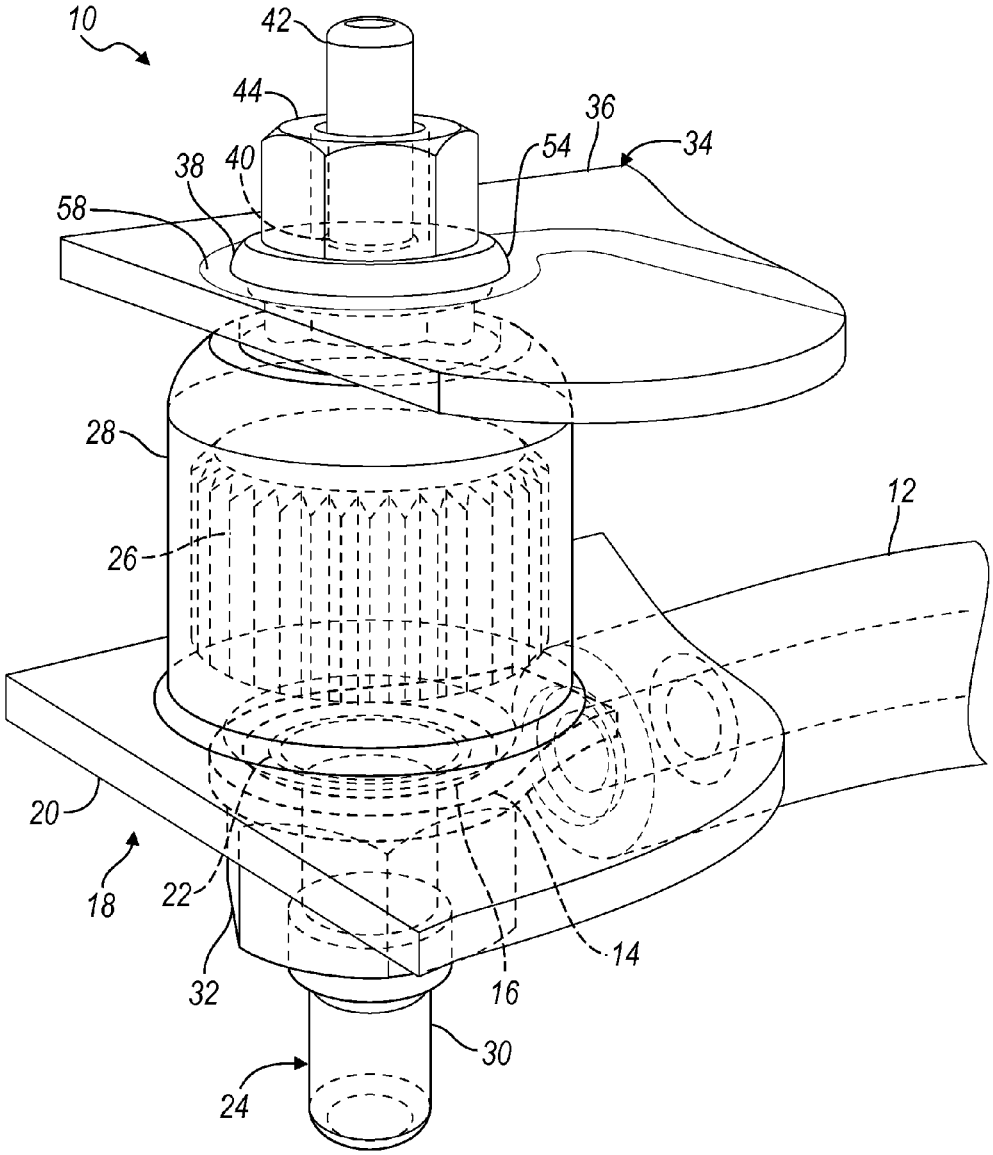
FIG. 1 is a perspective view of a vehicle power interface according to an embodiment.
Figure 2:
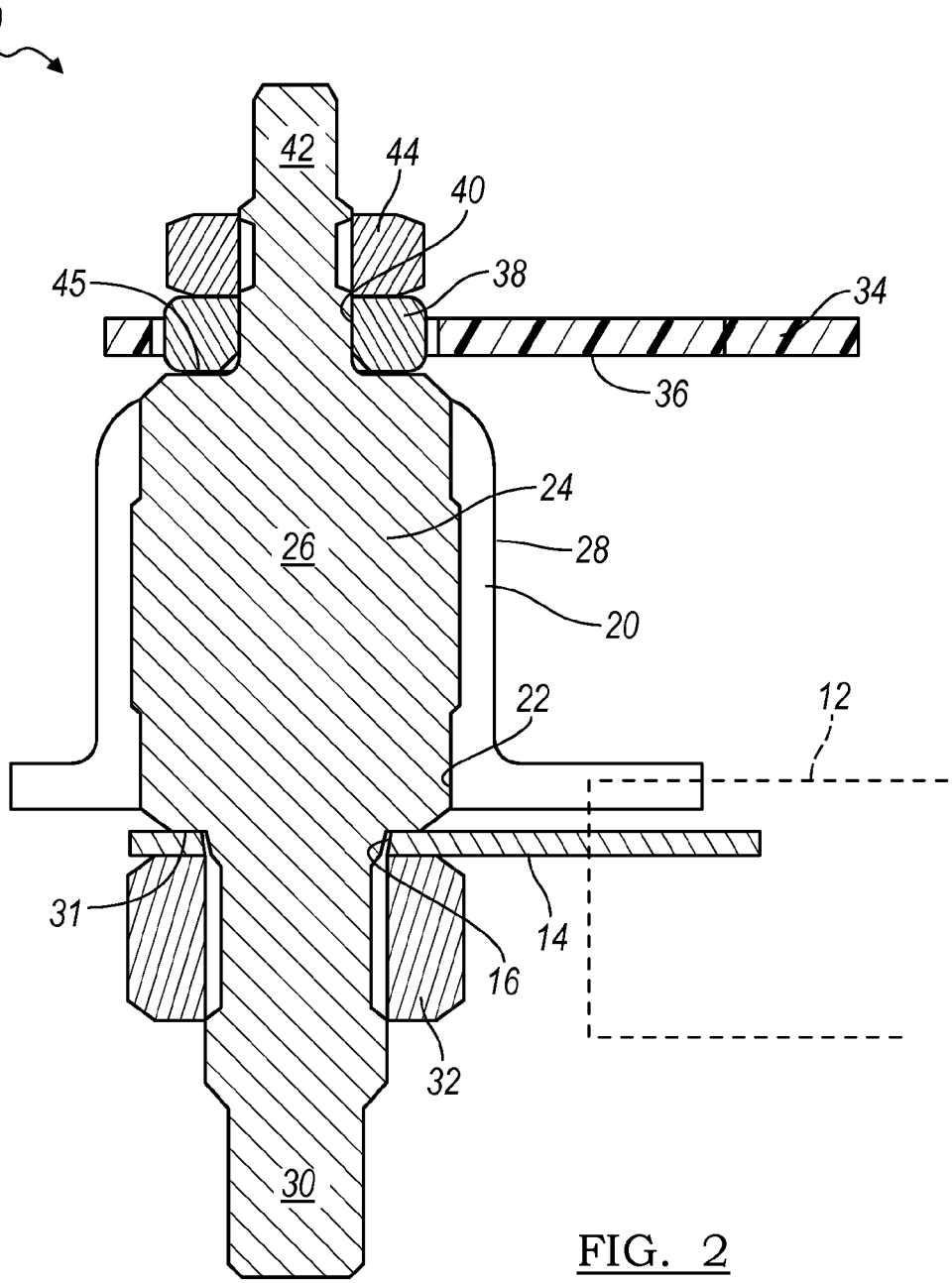
FIG. 2 is a section view of the vehicle power interface of FIG. 1.

With reference to FIGS. 1 and 2, a vehicle power interface, according to at least one embodiment, is illustrated and reference generally as numeral 10. The interface 10 is employed for conducting direct power from a power source or supply to a vehicle during a charging or recharging operation, for example. The interface 10 can be an internal vehicle connection; and may be an input supply to an Electronic Control Unit (ECU). The interface 10 includes a power supply cable 12 with a conductive connector 14 with an aperture 16 formed therethrough. The interface 10, and various components and embodiments of components may be employed for any power connection.

The ECU power interface 10 may include a circuit housing assembly 18, represented by a portion of a housing 20. The housing 20 may be formed of an insulative material. The housing 20 includes an aperture 22, which receives a conductive stud 24. The stud 24 includes a knurled body 26, which is insert-molded into a boss 28 on the housing 20. The stud 24 includes a threaded rod 30 extending through the housing aperture 22, external of the housing 20. The connector aperture 16 is oriented about the threaded rod 30, and retained in electrical contact with a corresponding abutment surface, or shoulder 31, on the stud body 26, by a nut 32 that is in threaded engagement with the threaded rod 30. The nut 32 may also be conductive; however, an engagement surface of the nut 32 with the threaded rod 30 is not relied upon as a conductive surface due to surface contact tolerances and potential contamination such caused by dirt or oils. Moreover, the nut 32 presses the connector 14 against the shoulder 31 of the stud 24 to provide the mechanical and electrical contact.

The interface 10 also includes a circuit board assembly 34 retained within the housing 20. The circuit board assembly 34 includes a printed circuit board (PCB) 36 with a conductive connector 38. The connector 38 has an aperture 40, which receives another threaded rod 42 extending from the stud 24. Another nut 44 is in threaded engagement with the internal threaded rod 42 to retain the PCB 36 upon the stud 24 without contacting the PCB 36, and to maintain an electrical and mechanical connection between the stud 24 and the connector 38. The connector 38 directly contacts another shoulder 45 on the stud body 26 to provide the electrical and mechanical connection between the stud 24 and the connector 38. The nut 44 may also be formed from a conductive material, but the nut 44 is not relied upon for the electrical contact. The nut 44 maintains the connector 38 and the stud 24 in the electrical contact. The threaded rods 30, 42 may be formed with any suitable thread dimension for a given application; and may have differing threads as depicted by the varying diameters.

The stud body 26 provides the shoulders 31, 45 for contact with the associated connectors 14, 38. The body 26 of the stud 24 is knurled for retention in the plastic housing 20 to prevent rotation when the nuts 32, 44 are screwed upon the threaded rods 30, 42. The stud body 26 is sufficiently robust for mechanical fixation of the connectors 14, 38 upon the threaded rods 30, 42, while mechanically isolating the compressive loads so that the loading is not distributed to the PCB 36. Assembly of the nut 32 to the threaded rod 30 is isolated from the interior components of the housing 20 by the body 26 of the stud 24. Any stress associated with outside connection of the nut 32 to the threaded rod 30 is transferred to the stud body 26, and consequently to the housing 20.

Figure 3:
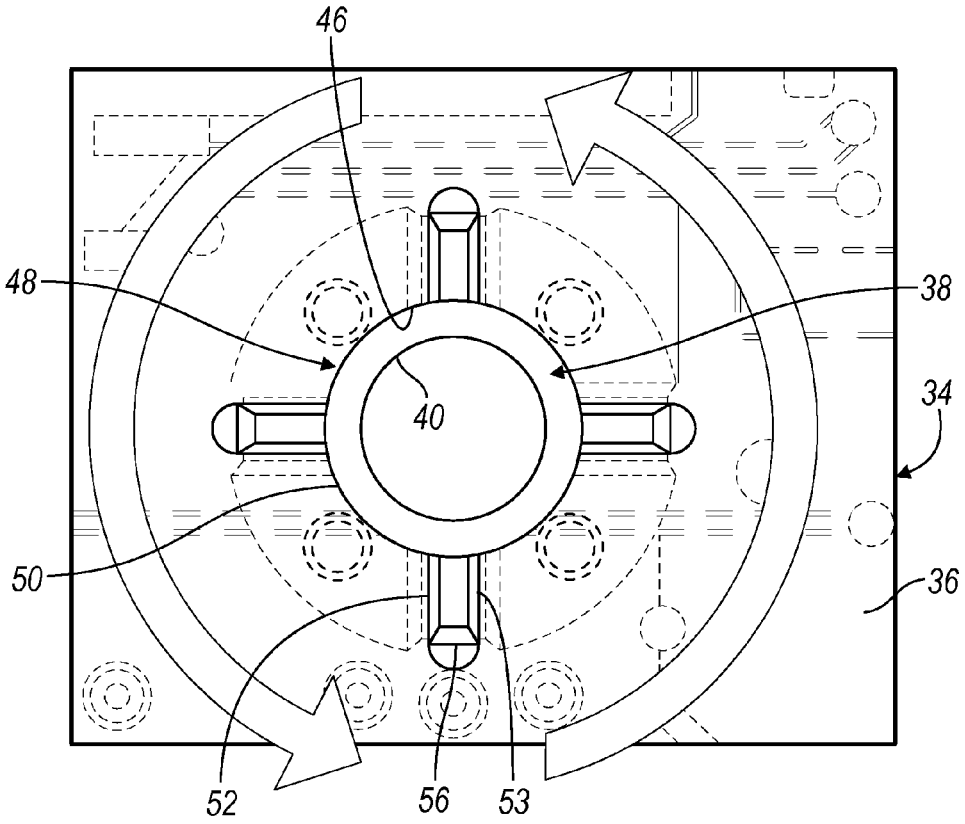
FIG. 3 is a bottom plan view of a circuit board assembly of the vehicle power interface of FIG. 1, according to an embodiment.
Figure 4:
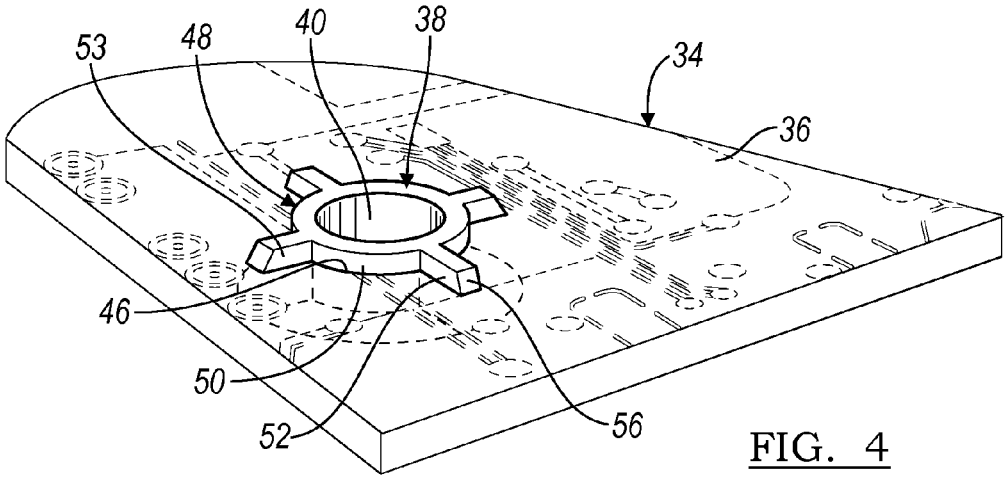
FIG. 4 is a perspective view of the circuit board assembly of FIG. 1.

Referring now to FIGS. 3 and 4, the connector 38 has an external profile that is not round. The PCB 36 has a corresponding aperture 46 that is not round also, to receive the connector 38, and to inhibit rotation of the connector 38 relative to the PCB 36 during installation of the nut 44 to the threaded rod 42 of the stud 24.

Figure 5:
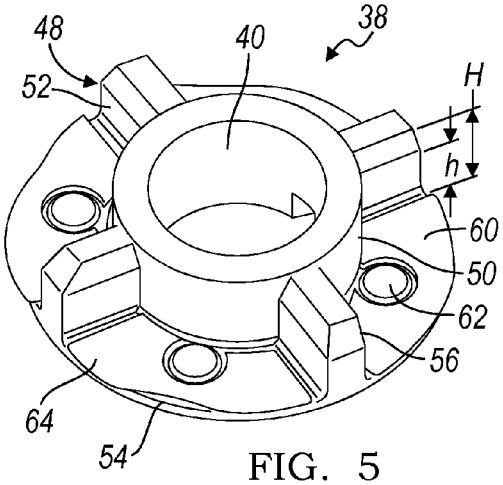
FIG. 5 is a bottom perspective view of a connector of the circuit board assembly of FIG. 3, according to an embodiment.
Figure 6:
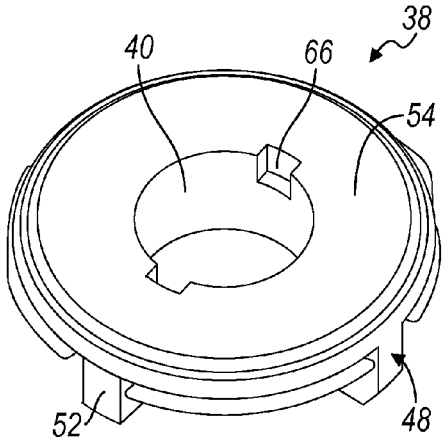
FIG. 6 is a top perspective view of the connector of FIG. 5.

The connector 38 is illustrated in FIGS. 5 and 6. The connector 38 has a body 48, which includes a generally cylindrical sleeve 50. The sleeve 50 provides the aperture 40 through the connector 38. A radial array of four ribs or projections 52 extend outward from the sleeve 50. Although four projections 52 are illustrated, any suitable number of projections may be employed. The example of four projections 52 optimizes the number of projections 52 and the force applied to each one. Due to specific PCB manufacturing processes, wherein round holes 46 and perpendicular linear drillings, or slots, 53 are cheaper than other manufacturing alternatives, a "cross" design, with four projections 52, optimizes surface to support rotation forces, while cost is minimized. The connector 38 may be formed from any suitable conductive material, such as stainless steel. Alternatively, the connector 38 may include copper or brass for soldering to the PCB (with tin or nickel plating, for example) while also cost effective.

The connector 38 includes a flange 54 at a proximal end of the connector for engaging the PCB 36. The projections 52 are tapered with leading surfaces 56 at a distal region of the connector 38 for alignment during installation. The projections 52 have a working height h that corresponds to a thickness of the PCB. The projections 52 have an overall height H greater than the working height h so that the tapered regions 56 extend past the PCB 36. The overall height H of the connector 38 isolates the PCB 36 from mechanical stresses associated with the stud 24, such as stresses caused by screwing the nut 44 to the stud 24 and stresses caused by vibrations to cable 12 distributed to the stud 24. This isolation prevents the PCB 36 from contact with the stud 24 and the nut 44.

Referring again to FIG. 1, the flange 54 engages a contact 58 upon the PCB 36 for providing an electrical connection with the PCB 36. Referring back to FIGS. 5 and 6, the flange 54 includes a bonding surface 60 adjacent the body 48 for bonding to the PCB contact 58. The bonding surface 60 is illustrated in FIG. 5. A plurality of contact pads 62 project from the bonding surface 60 for engagement with the PCB contact 58. An adherent, such as solder paste 64, is placed upon the bonding surface 60. Other suitable conductive adherents may be employed according to various embodiments. The contact pads 62 have a height that is sufficiently spaced from the bonding surface 60 to provide a gap between the PCB 36 and the flange 54 for receipt of the solder paste 64 without displacement of the solder paste 64. For example, the contact pads 62 may have an offset from the bonding surface 60 of approximately 0.15 millimeters.

FIG. 6 illustrates that a pair of notches 66 may be formed into the connector aperture 40 for engagement with an installation tool for alignment of the projections 52 into corresponding slots 53 of the PCB aperture 46. The projections 52 cooperate within the slots 53 for withstanding a mounting torque for installing the internal nut 44 upon the threaded rod 42. The flange 54, solder paste 64, and projections 52 provide a mechanical and electrical connection between the connector 38 and the PCB 36.

Figure 7:
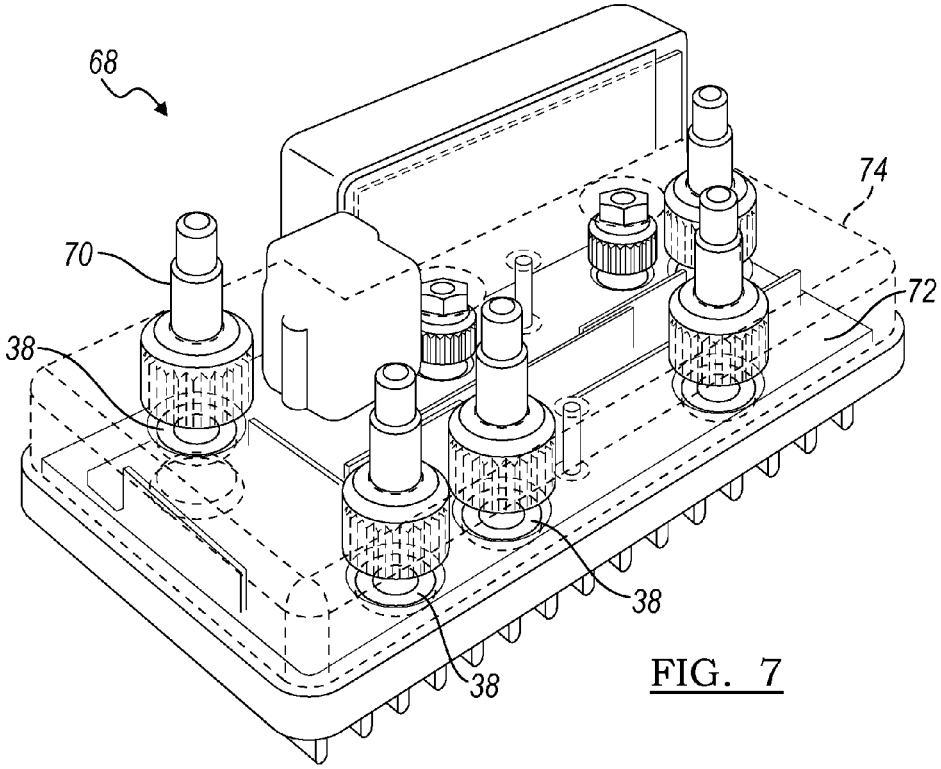
FIG. 7 is a perspective view of a vehicle power interface according to another embodiment.

FIG. 7 illustrates one direct power PCB interface 68 as an example, which may utilize the connector 38 for connecting each stud 70 to a PCB 72 within a housing 74 of the interface 68. Of course, the connector 38 may be employed for various connections beyond direct power.

The connector 38 provides a connection that is compact, simplified, and less costly than the prior art, while capable of being soldered and installed via automation. Additionally, the connector 38 avoids problems associated with the prior art, such as damaged to PCB imparted while applying a fastener to the PCB and/or vibrations transferred from the cable 12.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A circuit housing assembly comprising:
a housing with an aperture;
a circuit board assembly oriented within the housing, the circuit housing assembly comprising:
a printed circuit board (PCB) with an aperture that is not round; and
an electrical connector comprising a conductive body that is sized to be inserted into an aperture of a PCB for electrical connection with a circuit on the PCB, the body having an external profile that is not round to inhibit rotation of the body relative to a corresponding aperture in the PCB, and the body having a round aperture formed therein for receipt of an elongate conductive fastener for mechanical and electrical connection with the fastener; wherein the conductive body is received within the aperture of the PCB with the PCB aperture aligned with the housing aperture;
a conductive stud extending through the PCB aperture and the housing aperture; and
a nut mounted on the stud adjacent to the connector.

2. The circuit housing assembly of claim 1 wherein the body has an alignment configuration formed therein to cooperate with a tool during assembly for alignment of the body into the PCB aperture.

3. The circuit housing assembly of claim 1 wherein the body has a height sized greater than a thickness of the PCB to isolate the PCB from stress by installation of the fastener.

4. The circuit housing assembly of claim 1 wherein the body comprises:
a generally cylindrical sleeve; and
at least one projection extending outward from the sleeve.

5. The circuit housing assembly of claim 4 wherein the body further comprises a radial array of projections extending outward from the sleeve.

6. The circuit housing assembly of claim 5 wherein the radial array comprises four projections.

7. The circuit housing assembly of claim 4 further comprising a flange extending from the body.

8. The circuit housing assembly of claim 7 wherein the at least one projection has a profile with a leading surface spaced apart from the flange for alignment of the body into the PCB aperture.

9. A vehicle power interface comprising:
a circuit housing assembly comprising:
a housing with an aperture;
a circuit board assembly oriented within the housing, the circuit board assembly comprising:
a printed circuit board (PCB) with an aperture that is not round; and
an electrical connector comprising a conductive body that is sized to be inserted into an aperture of a PCB for electrical connection with a circuit on the PCB, the body having an external profile that is not round to inhibit rotation of the body relative to a corresponding aperture in the PCB, and the body having a round aperture formed therein for receipt of an elongate conductive fastener for mechanical and electrical connection with the fastener; wherein the conductive body is received within the aperture of the PCB with the PCB aperture aligned with the housing aperture;
a conductive stud extending through the PCB aperture and the housing aperture; and
a nut mounted on the stud adjacent to the connector;
a power supply having a conductive connector received upon the stud on an external side of the housing; and
a nut mounted on the stud adjacent to the power supply connector.

10. An electrical connector comprising:
a generally cylindrical conductive sleeve that is sized to be inserted into an aperture of a printed circuit board (PCB) for electrical connection with a circuit on the PCB, the sleeve having a round aperture formed therein for receipt of an elongate conductive fastener for mechanical and electrical connection with the fastener; and
at least one projection extending outward from the sleeve providing an external profile to inhibit rotation of the sleeve relative to a corresponding aperture in the PCB.

11. An electrical connector comprising:
a conductive body that is sized to be inserted into an aperture of a printed circuit board (PCB) for electrical connection with a circuit on the PCB, the body having an aperture formed therein for receipt of an elongate conductive fastener for mechanical and electrical connection with the fastener;

a flange extending from the body with a bonding surface; and at least one projection extending from the bonding surface to contact the PCB and to space the bonding surface away from the PCB for receipt of an adherent on the bonding surface.

12. A circuit board assembly comprising:

a printed circuit board (PCB) with an aperture;

an electrical connector comprising:

a conductive body that is sized to be inserted into an aperture of a PCB for electrical connection with a circuit on the PCB, the body having an aperture formed therein for receipt of an elongate conductive fastener for mechanical and electrical connection with the fastener;

a flange extending from the body with a bonding surface; and at least one projection extending from the bonding surface to contact the PCB and to space the bonding surface away from the PCB for receipt of an adherent on the bonding surface;

wherein the electrical connector is received within the aperture of the PCB, and an adherent between the flange and the PCB.

13. The circuit board assembly of claim 12 wherein the adherent is conductive.

14. The circuit board assembly of claim 12 wherein the adherent comprises solder.

15. The circuit board assembly of claim 12 wherein the adherent comprises a solder paste.

16. A circuit housing assembly comprising:

a housing with an aperture;

a circuit board assembly oriented within the housing, the circuit board assembly comprising:

a printed circuit board (PCB) with an aperture;

an electrical connector comprising:

a conductive body that is sized to be inserted into an aperture of a PCB for electrical connection with a circuit on the PCB, the body having an aperture formed therein for receipt of an elongate conductive fastener for mechanical and electrical connection with the fastener;

a flange extending from the body with a bonding surface; and at least one projection extending from the bonding surface to contact the PCB and to space the bonding surface away from the PCB for receipt of an adherent on the bonding surface;

wherein the electrical connector is received within the aperture of the PCB with the PCB aperture aligned with the housing aperture;

a conductive stud extending through the PCB aperture and the housing aperture; and a nut mounted on the stud adjacent to the connector.

17. A vehicle power interface comprising:

a circuit housing assembly comprising:

a housing with an aperture;

a circuit board assembly oriented within the housing, the circuit board assembly comprising:

a printed circuit board (PCB) with an aperture; and an electrical connector comprising:

a conductive body that is sized to be inserted into an aperture of a PCB for electrical connection with a circuit on the PCB, the body having an aperture formed therein for receipt of an elongate conductive fastener for mechanical and electrical connection with the fastener;

a flange extending from the body with a bonding surface; and at least one projection extending from the bonding surface to contact the PCB and to space the bonding surface away from the PCB for receipt of an adherent on the bonding surface;

wherein the electrical connector is received within the aperture of the PCB with the PCB aperture aligned with the housing aperture;

a conductive stud extending through the PCB aperture and the housing aperture; and a nut mounted on the stud adjacent to the connector;

a power supply having a conductive connector received upon the stud on an external side of the housing; and a nut mounted on the stud adjacent to the power supply connector.

* * * * *